US010464355B2

(12) United States Patent
Fujita

(10) Patent No.: US 10,464,355 B2
(45) Date of Patent: Nov. 5, 2019

(54) PRINTING APPARATUS, PRINTING METHOD, AND CONTROL APPARATUS

(71) Applicant: SEIKO EPSON CORPORATION, Tokyo (JP)

(72) Inventor: Toru Fujita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/067,848

(22) PCT Filed: Nov. 14, 2016

(86) PCT No.: PCT/JP2016/083677
§ 371 (c)(1),
(2) Date: Jul. 3, 2018

(87) PCT Pub. No.: WO2017/119192
PCT Pub. Date: Jul. 13, 2017

(65) Prior Publication Data

US 2019/0023034 A1 Jan. 24, 2019

(30) Foreign Application Priority Data

Jan. 5, 2016 (JP) ..... 2016-000408

(51) Int. Cl.

| | |
|---|---|
| ***B41J 15/08*** | (2006.01) |
| ***B41J 15/04*** | (2006.01) |
| ***B41J 11/00*** | (2006.01) |
| ***B41J 3/407*** | (2006.01) |

(52) U.S. Cl.
CPC ..... *B41J 15/08* (2013.01); *B41J 3/4078* (2013.01); *B41J 11/005* (2013.01); *B41J 11/0005* (2013.01); *B41J 11/0035* (2013.01); *B41J 11/0095* (2013.01); *B41J 15/048* (2013.01)

(58) Field of Classification Search
CPC ..... B41J 11/0095; B41J 11/005
See application file for complete search history.

(56) References Cited

U.S. PATENT DOCUMENTS

| | | | |
|---|---|---|---|
| 4,941,762 | A | 7/1990 | Murakami et al. |
| 5,718,527 | A | 2/1998 | Fujimoto et al. |

(Continued)

FOREIGN PATENT DOCUMENTS

| | | | |
|---|---|---|---|
| JP | 01-192582 | A | 8/1989 |
| JP | 08-174931 | A | 7/1996 |
| JP | 08-295058 | A | 11/1996 |

(Continued)

*Primary Examiner* — Julian D Huffman

(57) ABSTRACT

A printing apparatus, a printing method, and a control apparatus are provided that are capable of reliably preventing a printing unit from colliding, when a first press member or a second press member is displaced, with a displaced press member, and then allowing the printing unit to quickly restart a printing operation. A printing apparatus includes a transport unit configured to transport a work as a recording medium, a printing unit configured to perform printing on the work while moving in a width direction of the work, a first press member configured to press one side of the work in the width direction, a second press member configured to press another side of the work in the width direction, and a detecting unit configured to detect each of a displacement of the first press member in a vertical direction.

20 Claims, 11 Drawing Sheets

(56) References Cited

U.S. PATENT DOCUMENTS

| | | | | |
|---|---|---|---|---|
| 2013/0222446 | A1* | 8/2013 | Donahue | B41J 11/0095 347/8 |
| 2013/0222448 | A1* | 8/2013 | Donahue | B41J 2/17523 347/9 |

FOREIGN PATENT DOCUMENTS

| | | | |
|---|---|---|---|
| JP | 11-227171 | A | 8/1999 |
| JP | 2009-269254 | A | 11/2009 |
| JP | 2010-264596 | A | 11/2010 |

* cited by examiner

PRINTING APPARATUS, PRINTING METHOD, AND CONTROL APPARATUS

CROSS REFERENCE TO RELATED APPLICATIONS

This is a U.S. National Phase application of International Patent Application No. PCT/JP2016/083677, filed on Nov. 14, 2016, which claims priority to Japanese Patent Application No. 2016-000408, filed on Jan. 5, 2016. The entire disclosure of Japanese Patent Application No. 2016-000408 is expressly incorporated by reference herein.

TECHNICAL FIELD

The present invention relates to a printing apparatus, a printing method, and a control apparatus.

BACKGROUND

There is known a printing apparatus that performs ink-jet printing on a sheet-like recording medium (for example, refer to JP-A-2009-269254 and JP-A-2010-264596). This printing apparatus includes a head including multiple nozzles and is configured to transport a recording medium and discharge ink while moving the head in a direction (main scanning direction) perpendicular to a transport direction (sub scanning direction) of the recording medium.

An apparatus disclosed in JP-A-2009-269254 includes medium pressers that press both edges of a recording medium in a width direction and a detecting unit that detects a rotation angle of each medium presser. Furthermore, it is configured to prevent the medium pressers from colliding with the head based on a detection through the detecting unit. However, for example, when each medium presser rides over a binding portion of the recording medium, some states of the binding portion (e.g., the extent of thickness) makes it impossible to correctly detect the rotation angle of the medium presser, which may thus cause a collision of the medium presser and the head.

Moreover, an apparatus disclosed in JP-A-2010-264596 includes press members that press both edges of a recording medium in a width direction and a detecting unit that detects a rotation angle of each press member. Furthermore, it is configured to prevent the press member from colliding with a head based on a detection through the detecting unit. However, depending on a positional relationship between the binding portion of the recording medium and a rotation shaft of each press member, the press member may spring up, which may thus cause a collision of the press member and the head.

Moreover, in both apparatuses disclosed in JP-A-2009-269254 and JP-A-2010-264596, such malfunctions that impinge on accurate discharge of ink may be caused in the collided head, which makes it difficult or impossible to restart printing.

SUMMARY

An advantage of the present invention is to provide a printing apparatus, a printing method, and a control apparatus that are capable of reliably preventing a printing unit from colliding, when a first press member or a second press member is displaced, with a displaced press member and then allowing the printing unit to quickly restart a printing operation.

This advantage is provided by the following invention.

A printing apparatus of the present invention includes a transport unit configured to transport a recording medium that is band-shaped in a longitudinal direction of the recording medium, a printing unit configured to perform printing on the recording medium while moving in a width direction of the recording medium, a first press member configured to press one side of the recording medium in the width direction, a second press member configured to press another side of the recording medium in the width direction, and a detecting unit configured to detect each of a displacement of the first press member in a vertical direction and a displacement of the second press member in a vertical direction, and the printing unit undergoes a different movement depending on whether the displacement of the first press member is detected by the detecting unit or the displacement of the second press member is detected by the detecting unit.

Therefore, both when the first press member is displaced and when the second press member is displaced, the printing unit is reliably prevented from colliding with a displaced press member. Furthermore, after that, the detecting unit detects that the displaced press member has been returned to an original state, and after a detection, printing operation of the printing unit is quickly restarted.

In the printing apparatus of the present invention, it may be desirable that the detecting unit detects that the first press member is displaced in the vertical direction when an amount of the displacement of the first press member exceeds a threshold, and the detecting unit detects that the second press member is displaced in the vertical direction when an amount of the displacement of the second press member exceeds a threshold.

Therefore, printing by the printing unit is prevented from being unwillingly (unnecessarily) stopped, and hence production efficiency of the printing apparatus is also prevented from being reduced.

In the printing apparatus of the present invention, it may be desirable that the first press member and the second press member each include a plate piece that is cantilevered, and the detecting unit detects a displacement of an end portion of the plate piece on a free end side.

Since the end portion of the plate piece on the free end side is a portion having the largest amount of displacement in each press member, the displacement of each press member is easily and reliably detected.

In the printing apparatus of the present invention, it may be desirable that the detecting unit is arranged on the end portion of the plate piece on the free end side or includes an optical sensor, which is reflective, arranged to face the end portion of the plate piece on the free end side.

Therefore, with such a simple configuration, the displacement of each press member is correctly and reliably detected.

In the printing apparatus of the present invention, it may be desirable that the detecting unit includes a reflecting unit configured to reflect light from the optical sensor, the optical sensor is arranged on the end portion of the plate piece on the free end side, and the reflecting unit is provided over a range from above the first press member to above the second press member.

Therefore, as compared to a case where the reflecting unit is provided separately for each optical sensor, the number of parts is reduced.

In the printing apparatus of the present invention, it may be desirable that the printing unit is movable between a first movement limit position that is a movement limit on a first press member side and a second movement limit position that is a movement limit on a second press member side, and a movement range in which the printing unit is movable is divided into a first area between the first movement limit position to above the first press member, a second area from above the first press member to above the second press member, and a third area from above the second press member to the second movement limit position.

Therefore, a variety of operation patterns of the printing unit are easily controlled depending on whether the first press member is displaced or the second press member is displaced.

In the printing apparatus of the present invention, it may be desirable that when the displacement of the first press member is detected with the printing unit located in the second area, the printing unit stops the printing and waits in the second area or moves to the third area.

Therefore, the printing unit is reliably prevented from colliding with a displaced first press member.

In the printing apparatus of the present invention, it may be desirable that when the printing unit waits in the second area or moves to the third area, the transport unit transports the recording medium until the first press member returns to an original state before the first press member is displaced.

Therefore, the first press member is reliably returned to the original state, and the printing unit may subsequently move.

In the printing apparatus of the present invention, it may be desirable that when the transport unit transports the recording medium until the first press member returns to the original state before the first press member is displaced, the printing is restarted.

Therefore, the printing by the printing unit is quickly restarted, and hence production efficiency of the printing apparatus is prevented from being reduced as much as possible.

In the printing apparatus of the present invention, it may be desirable that when the displacement of one of the press members that are the first press member and the second press member is detected with the printing unit located in the first area, the printing unit waits in the first area.

Therefore, the printing unit is reliably prevented from colliding with the one of the press members that is displaced.

In the printing apparatus of the present invention, it may be desirable that when the printing unit waits in the first area, the transport unit transports the recording medium until the one of the press members returns to an original state before the one of the press members is displaced.

Therefore, the one of the press members is reliably returned to the original state, and the printing unit may subsequently move.

In the printing apparatus of the present invention, it may be desirable that when the transport unit transports the recording medium until the one of the press members returns to the original state before the one of the press members is displaced, the printing is restarted.

Therefore, the printing by the printing unit is quickly restarted, and hence production efficiency of the printing apparatus is prevented from being reduced as much as possible.

In the printing apparatus of the present invention, it may be desirable that when the displacement of the second press member is detected with the printing unit located in the second area, the printing unit stops the printing and moves to the first area.

Therefore, the printing unit is reliably prevented from colliding with a displaced second press member.

In the printing apparatus of the present invention, it may be desirable that when the printing unit moves to the first area, the transport unit transports the recording medium until the second press member returns to an original state before the second press member is displaced.

Therefore, the second press member is reliably returned to the original state, and the printing unit may subsequently move.

In the printing apparatus of the present invention, it may be desirable that when the transport unit transports the recording medium until the second press member returns to the original state before the second press member is displaced, the printing is restarted.

Therefore, the printing by the printing unit is quickly restarted, and thus production efficiency of the printing apparatus is prevented from being reduced as much as possible.

In the printing apparatus of the present invention, it may be desirable that when the displacement of one of the press members that are the first press member and the second press member is detected with the printing unit located in the third area, the printing unit waits in the third area.

Therefore, the printing unit is reliably prevented from colliding with the one of the press members that is displaced.

In the printing apparatus of the present invention, it may be desirable that when the printing unit waits in the third area, the transport unit transports the recording medium until the one of the press members returns to an original state before the one of the press members is displaced.

Therefore, the one of the press members is reliably returned to the original state, and the printing unit may subsequently move.

In the printing apparatus of the present invention, it may be desirable that when the transport unit transports the recording medium until the one of the press members returns to the original state before the one of the press members is displaced, the printing is restarted.

Therefore, the printing by the printing unit is quickly restarted, and thus production efficiency of the printing apparatus is prevented from being reduced as much as possible.

A printing method of the present invention performs printing on a recording medium by using the printing apparatus of the present invention.

Therefore, both when the first press member is displaced and when the second press member is displaced, the printing unit is reliably prevented from colliding with the displaced press member. In addition, then, the detecting unit also detects that the displaced press member returns to the original state, and after the detection, the printing operation of the printing unit is quickly restarted.

A control apparatus of the present invention is for controlling the printing apparatus of the present invention, and is configured to control the printing unit to undergo a different movement depending on whether the displacement of the first press member is detected or the displacement of the second press member is detected.

Therefore, both when the first press member is displaced and when the second press member is displaced, the printing unit is reliably prevented from colliding with the displaced press member. In addition, then, the detecting unit also detects that the displaced press member returns to the original state, and after the detection, the printing operation of the printing unit is quickly restarted.

DESCRIPTION OF EMBODIMENTS

Preferred exemplary embodiments that exemplify a printing apparatus, a printing method, and a control apparatus of the present invention will be described in detail below with reference to the accompanying drawings.

First Exemplary Embodiment

Figure 1:
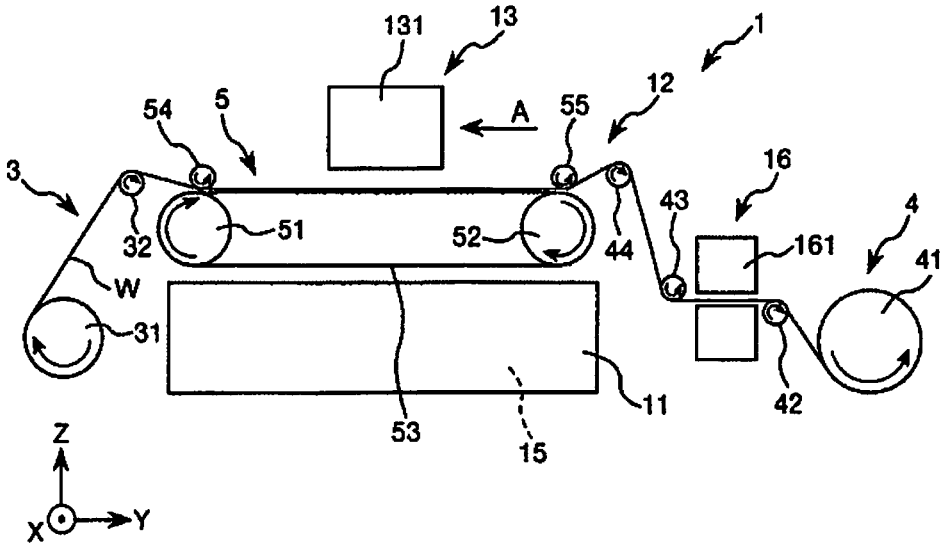
FIG. 1 is a side view illustrating an exemplary embodiment of a printing apparatus of the present invention.
Figure 2:
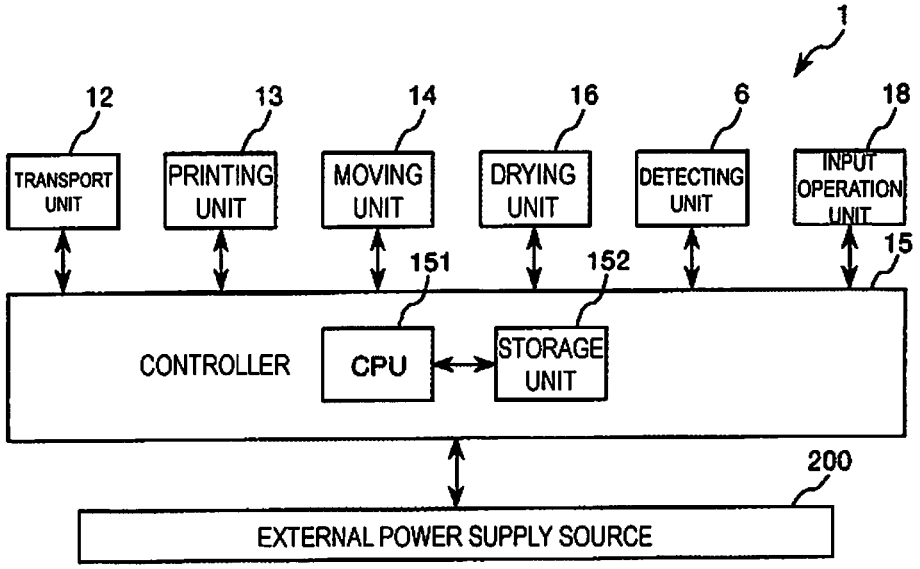
FIG. 2 is a block diagram of main components of the printing apparatus illustrated in FIG. 1.
Figure 3:
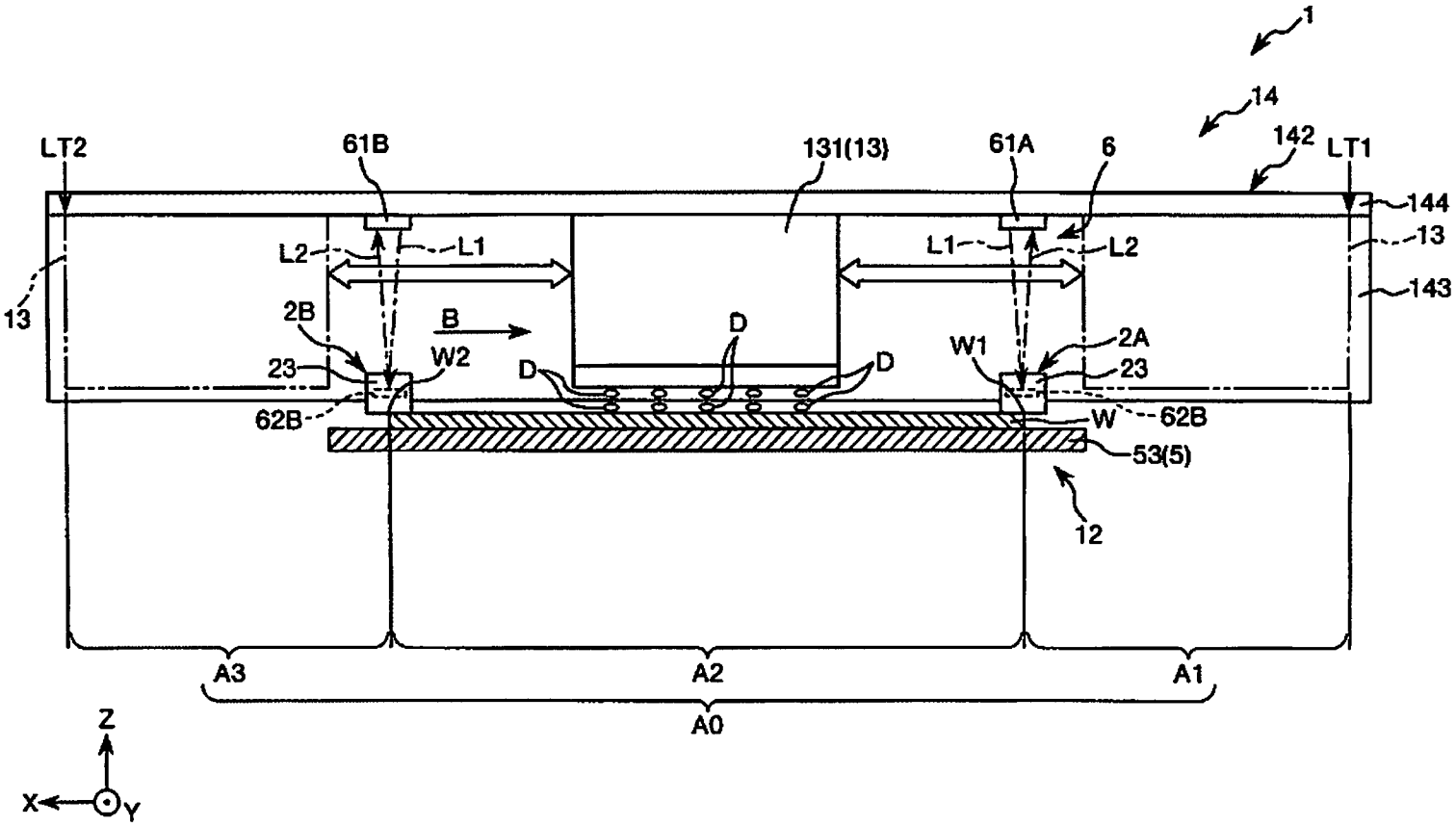
FIG. 3 is a diagram as viewed from an arrow A direction of FIG. 1.
Figure 4:
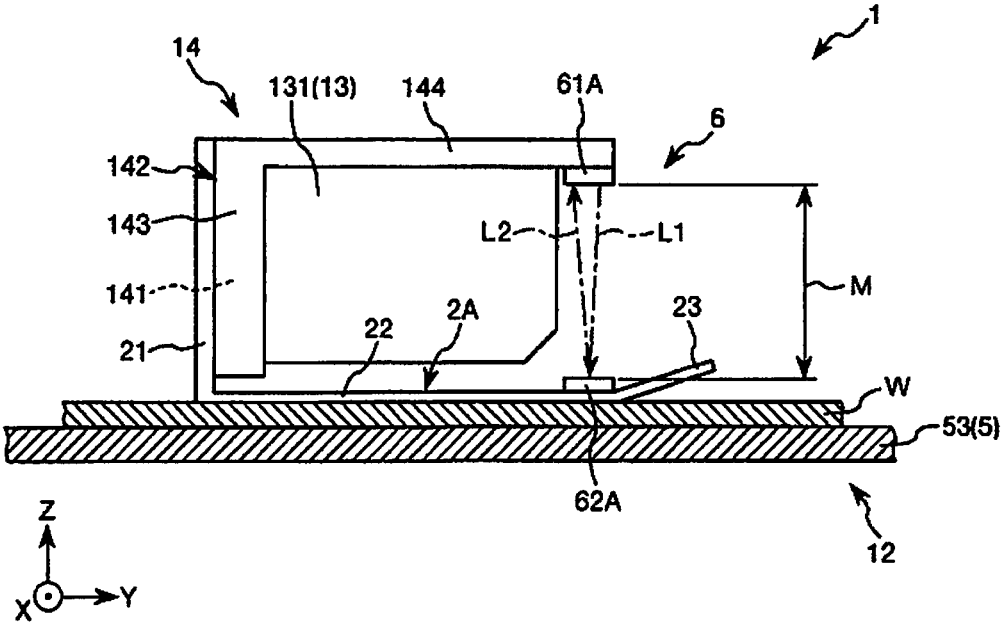
FIG. 4 is a diagram as viewed from an arrow B direction of FIG. 3.
Figure 5:
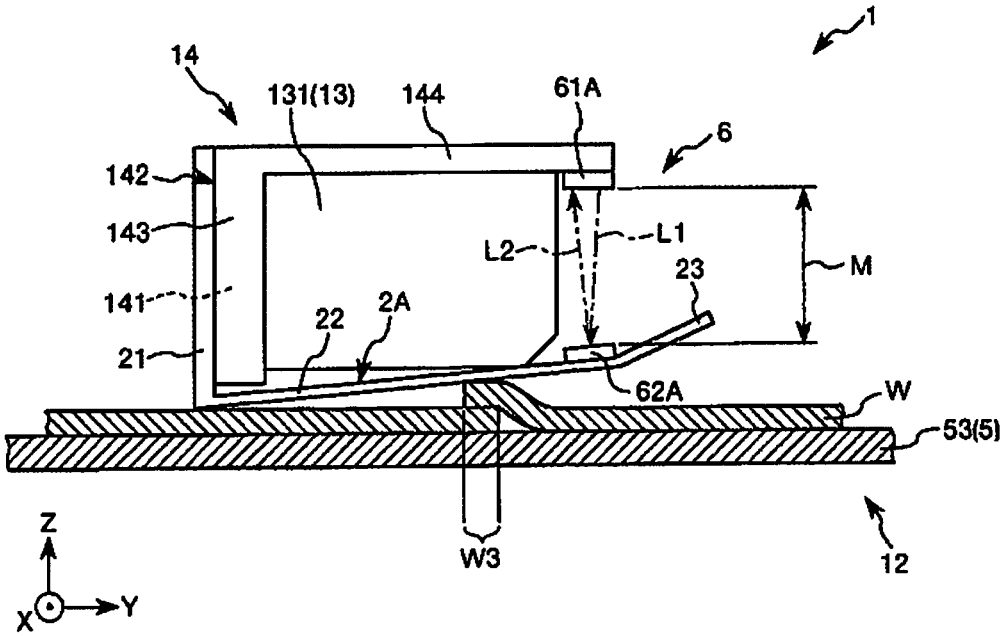
FIG. 5 is a diagram illustrating a state where a first press member is displaced from a state illustrated in FIG. 4.
Figure 10:
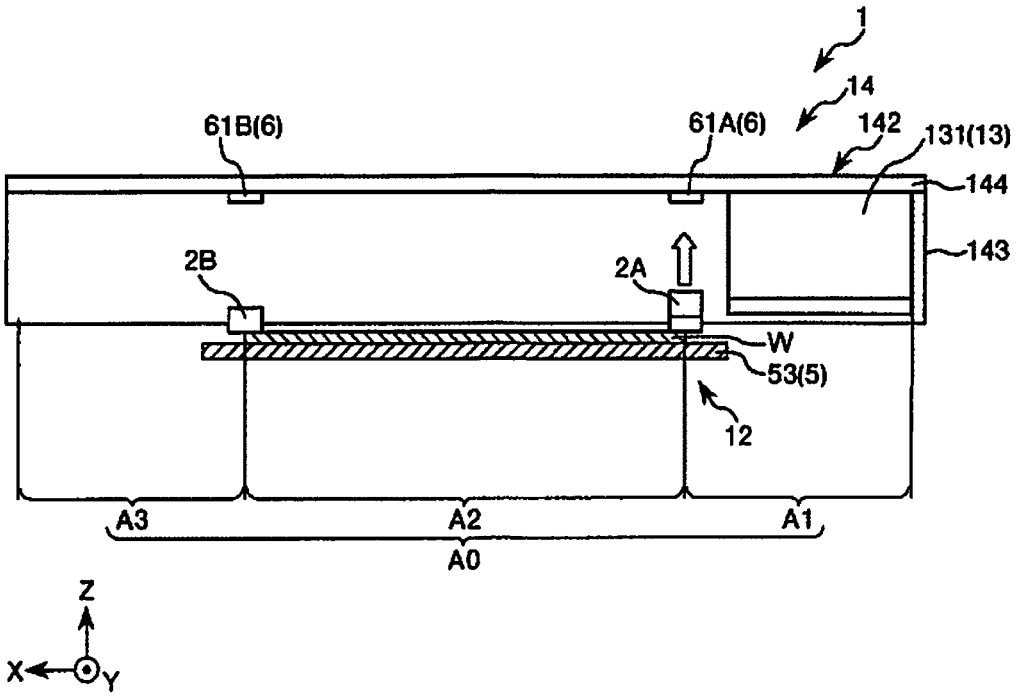
FIG. 10 is a diagram illustrating Operation Pattern 2 of the printing apparatus illustrated in FIG. 1 in a sequential manner.
Figure 11:
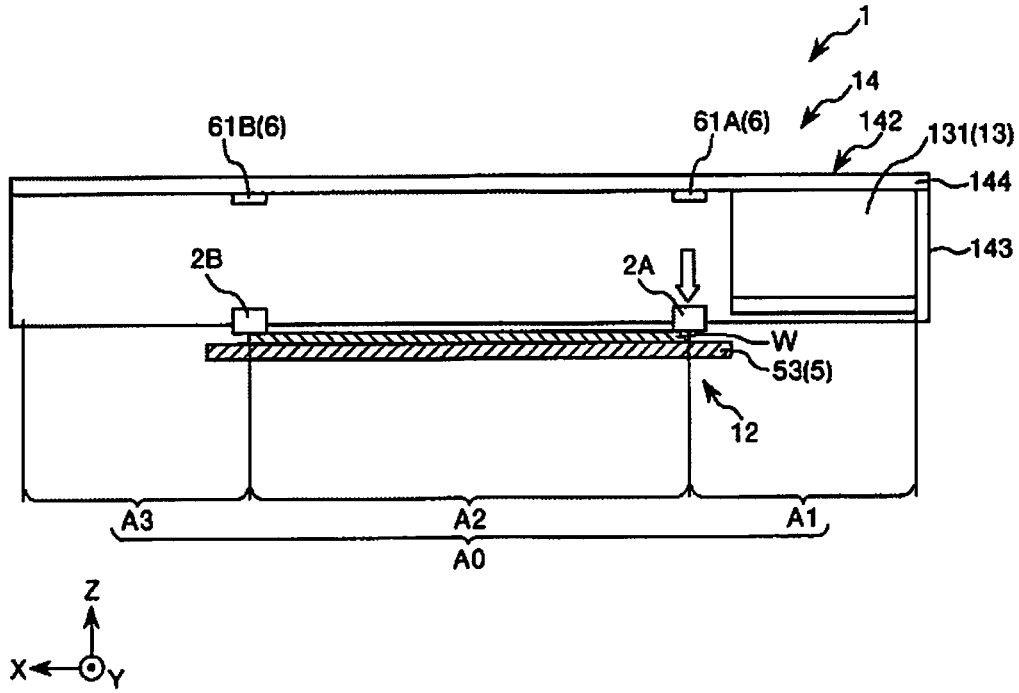
FIG. 11 is a diagram illustrating Operation Pattern 2 of the printing apparatus illustrated in FIG. 1 in the sequential manner.
Figure 12:
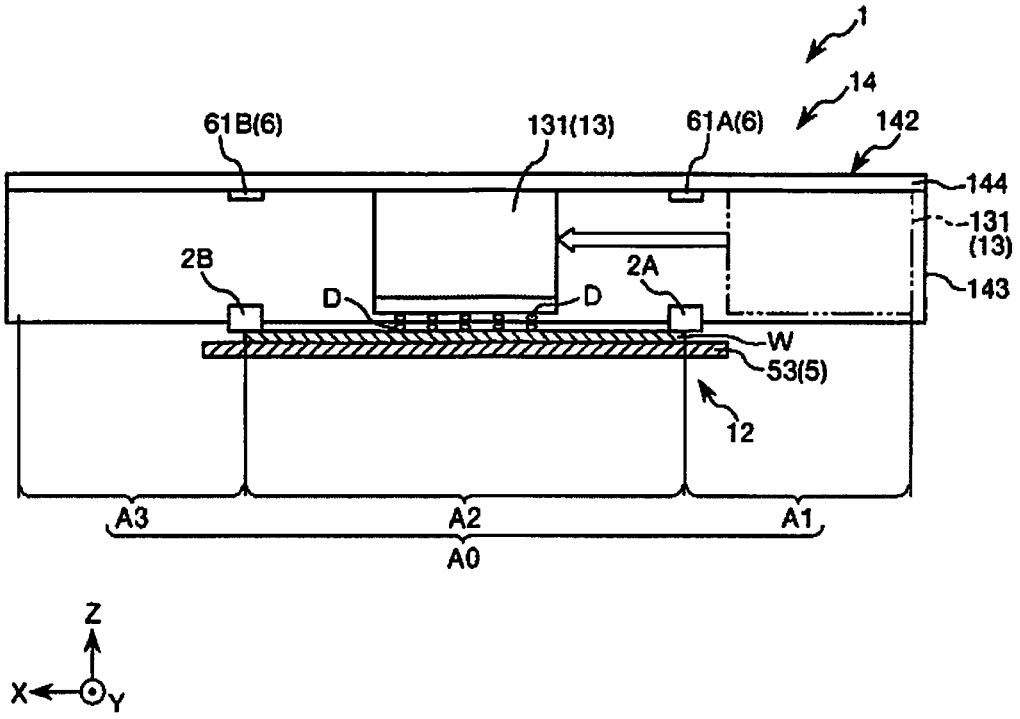
FIG. 12 is a diagram illustrating Operation Pattern 2 of the printing apparatus illustrated in FIG. 1 in the sequential manner.
Figure 17:
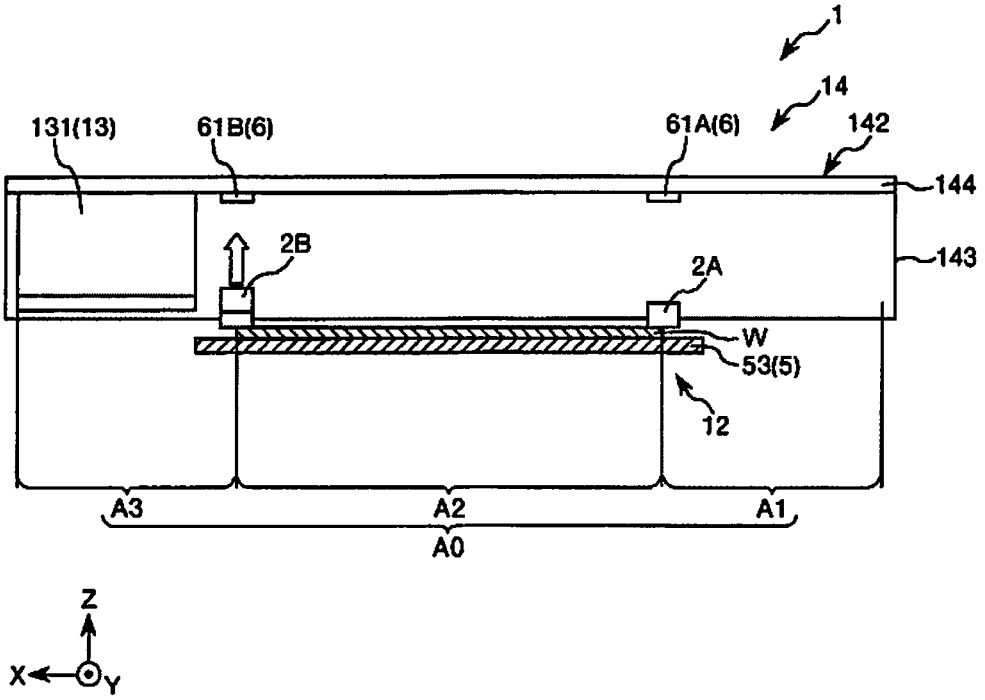
FIG. 17 is a diagram illustrating Operation Pattern 4 of the printing apparatus illustrated in FIG. 1 in a sequential manner.
Figure 18:
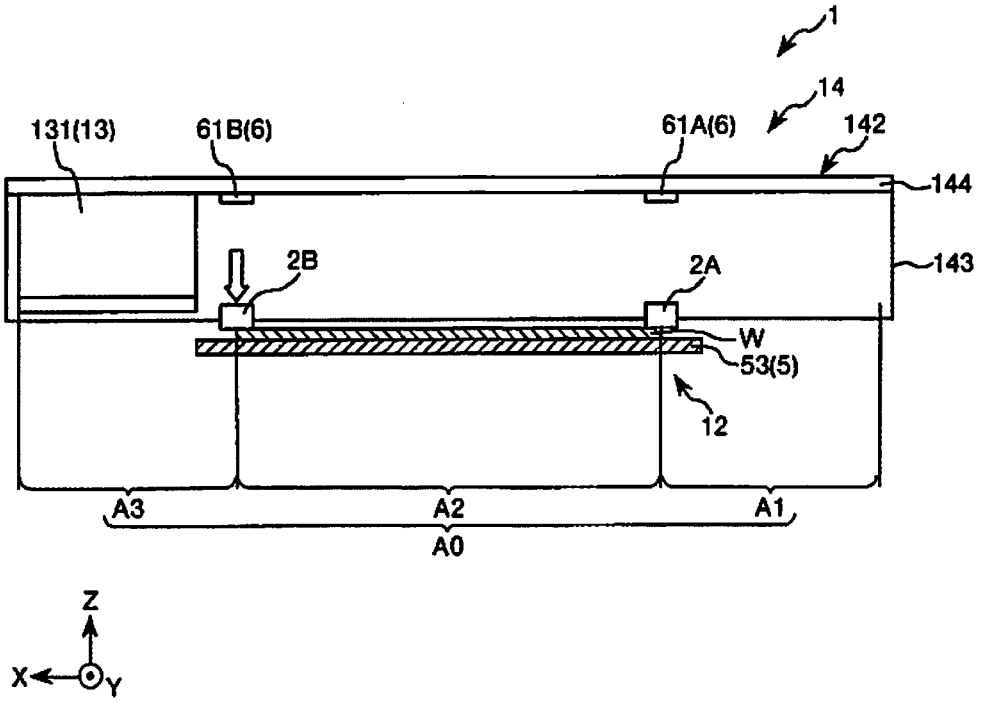
FIG. 18 is a diagram illustrating Operation Pattern 4 of the printing apparatus illustrated in FIG. 1 in the sequential manner.
Figure 19:
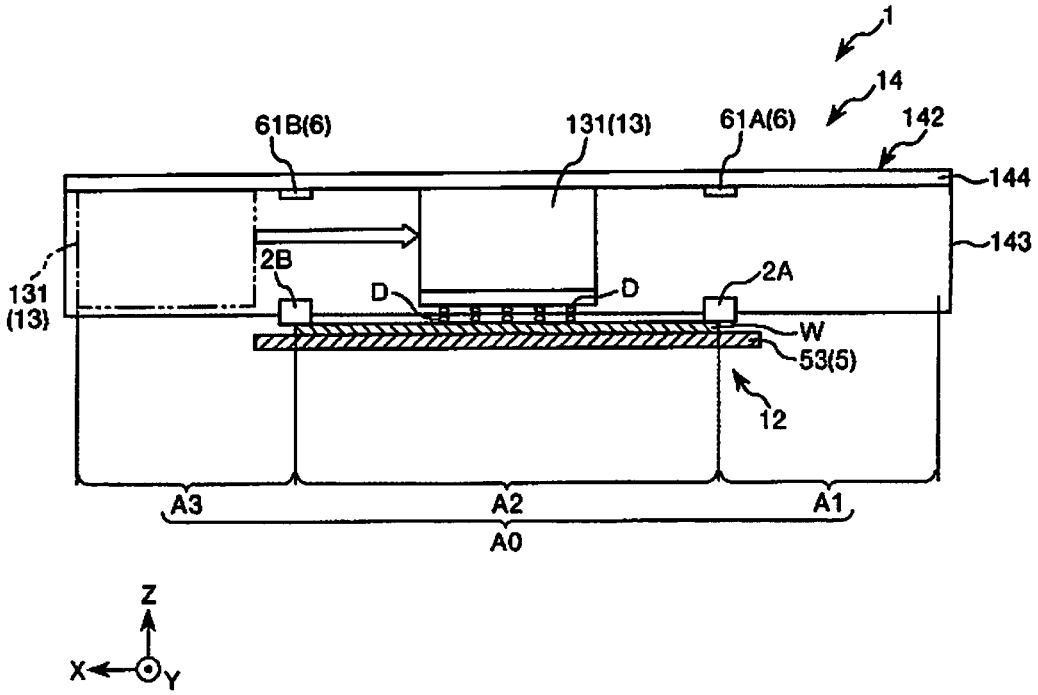
FIG. 19 is a diagram illustrating Operation Pattern 4 of the printing apparatus illustrated in FIG. 1 in the sequential manner.

FIG. 1 is a side view illustrating an exemplary embodiment of a printing apparatus of the present invention. FIG. 2 is a block diagram of main components of the printing apparatus illustrated in FIG. 1. FIG. 3 is a diagram as viewed from an arrow A direction of FIG. 1. FIG. 4 is a diagram as viewed from an arrow B direction of FIG. 3. FIG. 5 is a diagram illustrating a state where a first press member is displaced from a state illustrated in FIG. 4. FIG. 6 to FIG. 9 are each a diagram illustrating Operation Pattern 1 of the printing apparatus illustrated in FIG. 1 in a sequential manner. FIG. 10 to FIG. 12 are each a diagram illustrating Operation Pattern 2 of the printing apparatus illustrated in FIG. 1 in a sequential manner. FIG. 13 to FIG. 16 are each a diagram illustrating Operation Pattern 3 of the printing apparatus illustrated in FIG. 1 in a sequential manner. FIG. 17 to FIG. 19 are each a diagram illustrating Operation Pattern 4 of the printing apparatus illustrated in FIG. 1 in a sequential manner. Note that in the following, for convenience of explanation, a depth direction of a drawing sheet of FIG. 1 is referred to as an "X direction", a horizontal direction is referred to as a "Y direction", and a vertical direction is referred to as a "Z direction." Further, coordinate axes in FIG. 3 to FIG. 19 (and also FIG. 20) correspond to respective coordinate axes in FIG. 1.

A printing apparatus 1 of the present invention is a textile printing apparatus that performs printing on a work W, which is a recording medium, while transporting the work W, and the printing apparatus 1 performs a printing method of the present invention.

As illustrated in FIG. 1 and FIG. 2, the printing apparatus 1 includes a machine base 11, a transport unit 12 that transports the work W, a printing unit 13 that performs printing by applying ink onto the work W, a moving unit 14 that moves the printing unit 13, a drying unit 16 that dries the ink on the work W, an input operation unit 18 for inputting and setting various conditions for printing, and a controller 15 (a control apparatus of the present invention) that controls each operation of these units. Further, in the printing apparatus 1, the controller 15 is electrically connected to an external power supply source 200.

In the exemplary embodiment, a direction perpendicular to a transport direction in which the work W is transported is the X direction, a direction parallel to the transport direction is the Y direction, and a direction perpendicular to the X direction and the Y direction is the Z direction.

The transport unit 12 includes an unwinding device 3 that unwinds the work W having a long band shape and wound in a roll shape, a winding device 4 that winds the work W having been subjected to printing, and a supporting device 5 that is arranged on the machine base 11 and supports the work W being subjected to printing.

The unwinding device 3 is arranged on an upstream side with respect to the machine base 11 in a feed direction (Y direction) of the work W. The unwinding device 3 includes a feeding roller (unwinding reel) 31 on which the work W is wound in a roll shape and that feeds the work W and a tensioner 32 that applies tension to the work W between the feeding roller 31 and the supporting device 5. The feeding roller 31 is connected to a motor (not illustrated) and is rotated by the driving of the motor.

Note that as the work W, both a thin film sheet having ink absorbency and a thin film sheet not having ink absorbency may be used. The former case includes sheets of paper exclusive for ink jet recording, such as plain paper, fine paper, and glossy paper, and other sheets such as textile and fabric. The latter case includes plastic films not coated for ink jet recording (including no ink absorbent layer), sheets in which a plastic is coated on a base material such as paper, and sheets to which a plastic film adheres. The plastic includes, but is not limited to, polyvinyl chloride, polyethylene terephthalate, polycarbonate, polystyrene, polyurethane, polyethylene, and polypropylene.

The winding device 4 is arranged on a downstream side with respect to the machine base 11 in the feed direction (Y direction) of the work W. The winding device 4 includes a winding roller (winding reel) 41 that winds the work W in a roll shape and tensioners 42, 43, and 44 that apply tension to the work W between the winding roller 41 and the supporting device 5. The winding roller 41 is connected to a motor (not illustrated) and is rotated by the driving of the motor. The tensioners 42 to 44 are arranged at intervals in this order in a direction away from the winding roller 41.

The supporting device 5 is arranged between the unwinding device 3 and the winding device 4. The supporting device 5 includes a main driving roller 51 and a driven roller 52 that are arranged to be spaced apart from each other in the Y direction, an endless belt (belt) 53 that is wound around the main driving roller 51 and the driven roller 52, and tensioners 54 and 55 that apply tension to the work W between the main driving roller 51 and the driven roller 52.

The main driving roller 51 is connected to a motor (not illustrated) and is rotated by the driving of the motor. Further, the driven roller 52 is subjected to a rotating force of the main driving roller 51 through the endless belt 53, and thus is rotated to follow the main driving roller 51.

The endless belt 53 is a glue belt including a front surface on which an adhesive layer having adhesiveness is included. A part of the work W is adhesively fixed on the adhesive layer and transported in a longitudinal direction of the work W, that is, the Y direction. Thus, during transportation, the work W is stably subjected to printing. Furthermore, after the printing is performed, the work W is separated from the endless belt 53.

The tensioners 54 and 55 are arranged to be spaced apart from each other in the Y direction, as with the main driving roller 51 and the driven roller 52.

The tensioner 54 is capable of sandwiching, with the main driving roller 51, the work W together with the endless belt 53, and the tensioner 55 is capable of sandwiching, with the driven roller 52, the work W together with the endless belt 53. Thus, the work W, to which tension is applied by the tensioners 54 and 55, is transported while fixed on the endless belt 53 with the work W subjected to the tension. In such state, the work W is prevented from becoming wrinkled and the like during transportation, and hence printing, when performed, becomes accurate and high quality.

The printing unit 13 is capable of discharging the ink, as a droplet D, onto the work W being transported by the transport unit 12 (refer to FIG. 3). Therefore, the droplet D lands on the work W, and accordingly, the work W is subjected to drawing (recording) through printing. Note that the ink contains water as a solvent and dye or pigment as a colorant, and in the exemplary embodiment, four colors including black (K), cyan (C), magenta (M), and yellow (Y) are used.

In addition, the printing unit 13 also includes a carriage unit 131 that includes a plurality of ink jet heads (ink discharging heads) which are separated for respective colors. In the printing apparatus 1, the work W is intermittently transported in the Y direction (sub scanning) in a fixed state where the work W unwound by the unwinding device 3 is adhesively fixed on the endless belt 53, and the ink is discharged from the carriage unit 131 while the carriage unit 131 is reciprocated by the moving unit 14 in the X direction (the width direction of the work W) with respect to the fixed work W (main scanning). This operation is performed until an image is formed on the work W by completion of the printing. Note that a resulting image may be a multicolor printed one (color printed) or a single color printed one.

The moving unit 14 is to movably support the printing unit 13 along the X direction during printing. Thus, the printing unit 13 reciprocates over the work W and applies ink onto the work W during reciprocation (refer to FIG. 3).

As illustrated in FIG. 4 and FIG. 5, the moving unit 14 includes a drive source 141 that moves the printing unit 13 and a frame 142 that extends in the X direction and supports the drive source 141.

The drive source 141 has a configuration including a ball screw and a linear guide, for example.

In the exemplary embodiment, the frame 142 includes a back plate 143 that rises in the Z direction and a top plate 144 that protrudes toward a positive side of the Y direction from the back plate 143.

As illustrated in FIG. 3, a first press member 2A that presses an edge W1 of the work W on the right side (one side in the width direction) in FIG. 3 and a second press member 2B that presses an edge W2 of the work W on the left side (another side in the width direction) in FIG. 3 are provided partway in the longitudinal direction of the back plate 143. Furthermore, the printing unit 13 (carriage unit 131) moves between a first movement limit position LT1 that is a movement limit on a first press member 2A side and a second movement limit position LT2 that is a movement limit on a second press member 2B side. Note that the first movement limit position LT1 is a home position (normal standby position) of the printing unit 13.

Moreover, a range between the first movement limit position LT1 and the second movement limit position LT2, that is, a movement range A0 in which the printing unit 13 is movable is divided into a first area A1 from the first movement limit position LT1 to above the first press member 2A, a second area A2 from above the first press member 2A to above the second press member 2B, and a third area A3 from above the second press member 2B to the second movement limit position LT2. In this way, the movement range A0 is divided into three areas, and thus Operation Pattern 1 to Operation Pattern 4 described later are easily controlled.

The drying unit 16 is arranged on the downstream side with respect to the printing unit 13 in the transport direction of the work W and between the supporting device 5 and the winding roller 41 of the winding device 4. The drying unit 16 includes a chamber 161 including a heater that is built-in. Consequently, when the work W passes through the chamber 161, undried ink is dried by heat from the heater.

Note that the tensioner 42 and the tensioner 43 are arranged in the Y direction on both sides of the drying unit 16. Consequently, the work W is allowed to pass through the chamber 161 with the work W subjected to tension. In such state, the work W is prevented from becoming wrinkled and the like during passage, and hence ink is reliably dried.

The input operation unit 18 includes, for example, a touch panel. The input operation unit 18 allows an operator who operates the printing apparatus 1 to input various conditions for printing. The various conditions include, but are not limited to, a print program, a transport velocity of the work W, and a thickness of the work W. Note that the input operation unit 18 also serves as a display that displays information of the printing apparatus 1.

The controller 15 is electrically connected to the transport unit 12, the printing unit 13, the moving unit 14, the drying unit 16, a detecting unit 6, and the input operation unit 18, and includes functions to control each of these units. As illustrated in FIG. 2, the controller 15 includes a CPU (Central Processing Unit) 151 and a storage unit 152.

The CPU 151 executes programs for various processing such as the print process described above.

The storage unit 152 includes, for example, an EEPROM (Electrically Erasable Programmable Read-Only Memory), which is a type of non-volatile semiconductor memory, and stores various programs and the like.

The controller 15 is electrically connected to the external power supply source 200 that supplies a voltage of 200 V, for example. Thus, electric power is supplied to respective units of the printing apparatus 1.

As described above, in the frame 142, the first press member 2A that presses the edge W1 of the work W and the second press member 2B that presses the edge W2 of the work W are provided (refer to FIG. 3). Since the first press member 2A and the second press member 2B are of identical configuration, except that arrangement positions are different, the first press member 2A will be described below as a typical example.

As illustrated in FIG. 4, the first press member 2A is formed as a long plate piece that is bent, and includes an end that is cantilevered. The first press member 2A includes a fixed part 21 that is supported by and fixed to the back plate 143 of the frame 142, a contact part 22 that contacts the edge W1 of the work W, and an inclined part 23 that is inclined with respect to the contact part 22. Note that it may be desirable that the first press member 2A include elastic stainless steel.

The fixed part 21 is fixed to the back plate 143 of the frame 142 through, for example, a bolt (not illustrated).

The contact part 22 extends toward a positive side of the Y direction from a bottom end of the fixed part 21. Furthermore, the contact part 22 is capable of contacting the edge W1 of the work W and pressing the edge W1 against the endless belt 53, in other words, sandwiching the edge W1 against the endless belt 53. Therefore, for example, even when the edge W1 is folded towards a back side of the work W or the edge W1 has a fluffy part, such a part is restrained and hence the edge W1 is prevented from colliding with the printing unit 13. Consequently, the work W is preserved in a state suitable for the printing, which enables stable, accurate printing.

The inclined part 23 is a part that further extends toward the positive side of the Y direction from the contact part 22. The inclined part 23 is inclined with respect to the contact part 22 and is in a state apart from the work W on the endless belt 53.

Incidentally, as illustrated in FIG. 5, the work W is formed from joined (bonded) sheets of fabric, and joint parts W3 are formed in the work W. Further, each joint part W3 is thicker than front and back parts. The first press member 2A and the second press member 2B may ride over the joint part W3 during transportation of the work W, and in this case, the contact part 22 is in a state rising up from the work W, that is, a bent state. Depending on the degree of rising, the printing unit 13 in motion in the X direction may collide with the contact part 22. Furthermore, after collision, damage or deformation due to the collision may occur in the printing unit 13 or the contact part 22, which makes it difficult or impossible to continue printing. Therefore, the printing apparatus 1 of the present invention includes a configuration that such incident is effectively eliminated. The following description is for such configuration.

As illustrated in FIG. 3, the printing apparatus 1 includes the detecting unit 6 that detects each of the displacement of the first press member 2A in the vertical direction and the displacement of the second press member 2B in the vertical direction. The detecting unit 6 is electrically connected to the controller 15 (refer to FIG. 2).

The detecting unit 6 includes a first optical sensor 61A, a first reflecting member (reflecting unit) 62A, a second optical sensor 61B, and a second reflecting member (reflecting unit) 62B.

As illustrated in FIG. 4 and FIG. 5, the first reflecting member 62A is arranged on and fixed to a portion of the first press member 2A as close to a free end of the contact part 22 as possible, that is, a portion that is as close to the inclined part 23 as possible. The first optical sensor 61A is a reflective optical sensor and is arranged on and fixed to the top plate 144 of the frame 142 to face the first reflecting member 62A.

Output light L1 emitted from the first optical sensor 61A is reflected on the first reflecting member 62A, is received on the first optical sensor 61A as reflected light L2, and is imaged on a light receiving element built in the first optical sensor 61A. An imaging position is different depending on a distance M between the first optical sensor 61A and the first reflecting member 62A (refer to FIG. 4 and FIG. 5). Furthermore, the distance M detected based on the imaging position is referred to as an amount of displacement of the contact part 22 of the first press member 2A in the vertical direction. Note that the reason why a detecting portion for detecting the displacement of the first press member 2A in the vertical direction is set as the portion that is as close to the free end of the contact part 22 as possible is that the portion has the largest amount of displacement in the first press member 2A and hence the displacement is easily and reliably detected.

The second reflecting member 62B is arranged on and fixed to a portion of the second press member 2B as close to the free end of the contact part 22 as possible. As with the first optical sensor 61A, the second optical sensor 61B is a reflective optical sensor and is arranged on and fixed to the top plate 144 of the frame 142 to face the second reflecting member 62B. Note that the mechanism of detecting the displacement of the second press member 2B in the vertical direction is identical to the mechanism of detecting the displacement of the first press member 2A in the vertical direction.

The printing apparatus 1 is capable of performing four operation patterns based on a detection result of the detecting unit 6 and a position of the printing unit 13, that is, position information that indicates which one of the first area A1 to the third area A3 is the area in which the printing unit 13 is located. Note that the position information of the printing unit 13 is obtained from, for example, an encoder built-in in the drive source 141 that moves the printing unit 13.

A first operation pattern of the four operation patterns is Operation Pattern 1 illustrated in FIG. 6 to FIG. 9. A second operation pattern is Operation Pattern 2 illustrated in FIG. 10 to FIG. 12. A third operation pattern is Operation Pattern 3 illustrated in FIG. 13 to FIG. 16. A fourth operation pattern is Operation Pattern 4 illustrated in FIG. 17 to FIG. 19. Furthermore, switching between each operation pattern is performed by the CPU 151 of the controller 15, and a program for performing each operation pattern is stored in advance in the storage unit 152 of the controller 15.

First, Operation Pattern 1 will be described with reference to FIG. 6 to FIG. 9.

Figure 6:
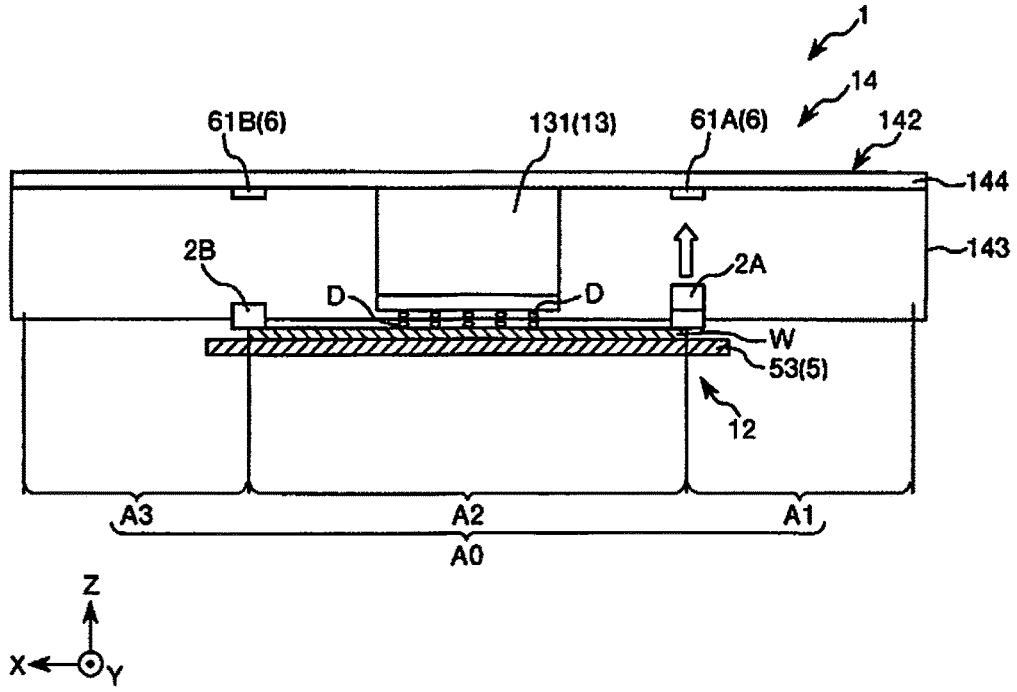
FIG. 6 is a diagram illustrating Operation Pattern 1 of the printing apparatus illustrated in FIG. 1 in a sequential manner.

In the state illustrated in FIG. 6, the printing unit 13 is located in the second area A2 and is performing printing by discharging droplet D onto the work W being transported. Furthermore, the first press member 2A is pressed upward by the joint part W3 of the work W and is thus displaced. This displacement is detected by the first optical sensor 61A (detecting unit 6).

Figure 7:
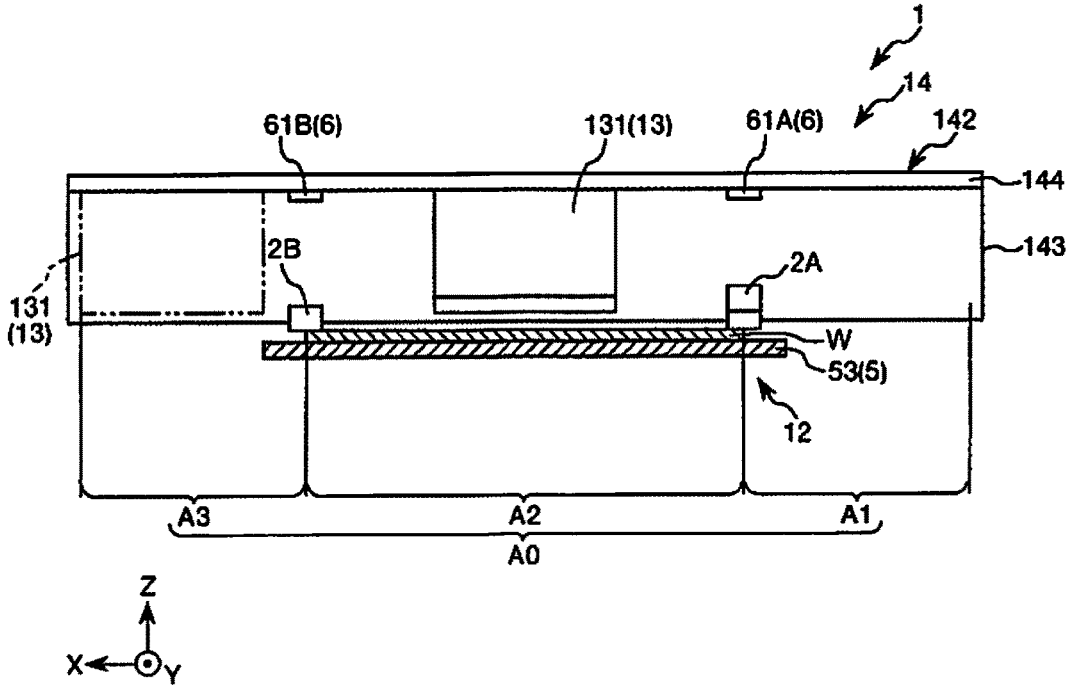
FIG. 7 is a diagram illustrating Operation Pattern 1 of the printing apparatus illustrated in FIG. 1 in the sequential manner.

When the displacement of the first press member 2A is detected, the discharge of the droplet D from the printing unit 13 is stopped, that is, the printing is stopped, as illustrated in FIG. 7. In addition, the movement of the printing unit 13 in the second area A2 is stopped, and the printing unit 13 waits, as is, in the second area A2. Note that the printing unit 13 may be moved to the third area A3 (see the printing unit 13 represented by a two-dot chain line in FIG. 7) instead of the printing unit 13 waiting in the second area A2. Furthermore, the transportation of the work W is desirably stopped, but may be continued.

Figure 8:
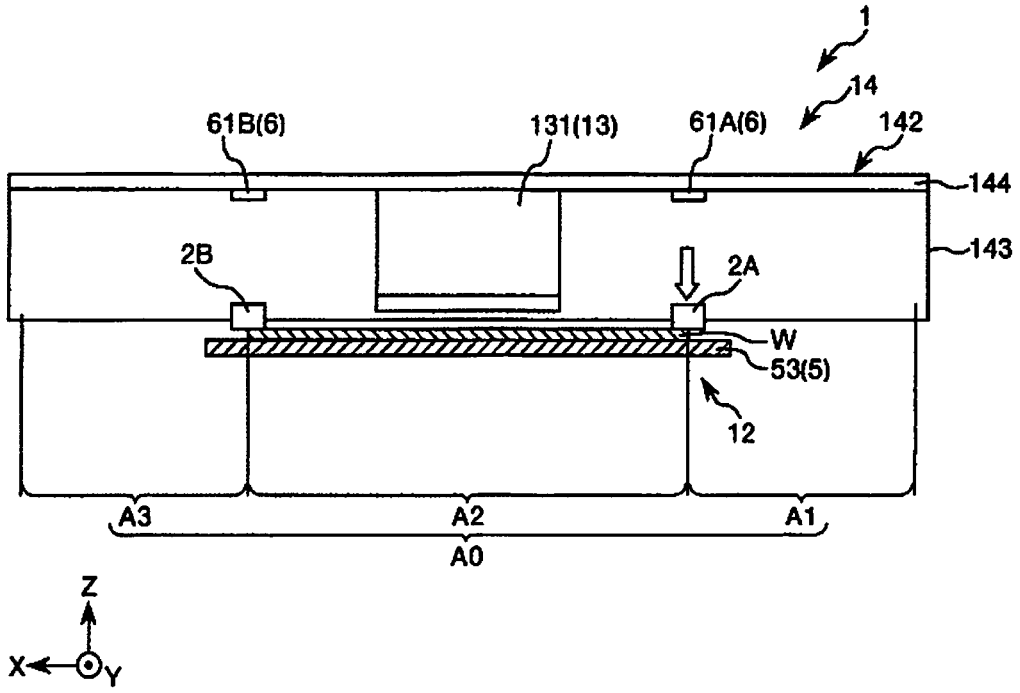
FIG. 8 is a diagram illustrating Operation Pattern 1 of the printing apparatus illustrated in FIG. 1 in the sequential manner.

Next, from the state illustrated in FIG. 7, the transportation of the work W is performed by the transport unit 12. Thus, as illustrated in FIG. 8, the first press member 2A may ride over the joint part W3 that causes the displacement, and as a result, the first press member 2A returns to the original state before displacement. Furthermore, this displacement, that is, a displacement for returning to the original state, is also detected by the first optical sensor 61A.

Figure 9:
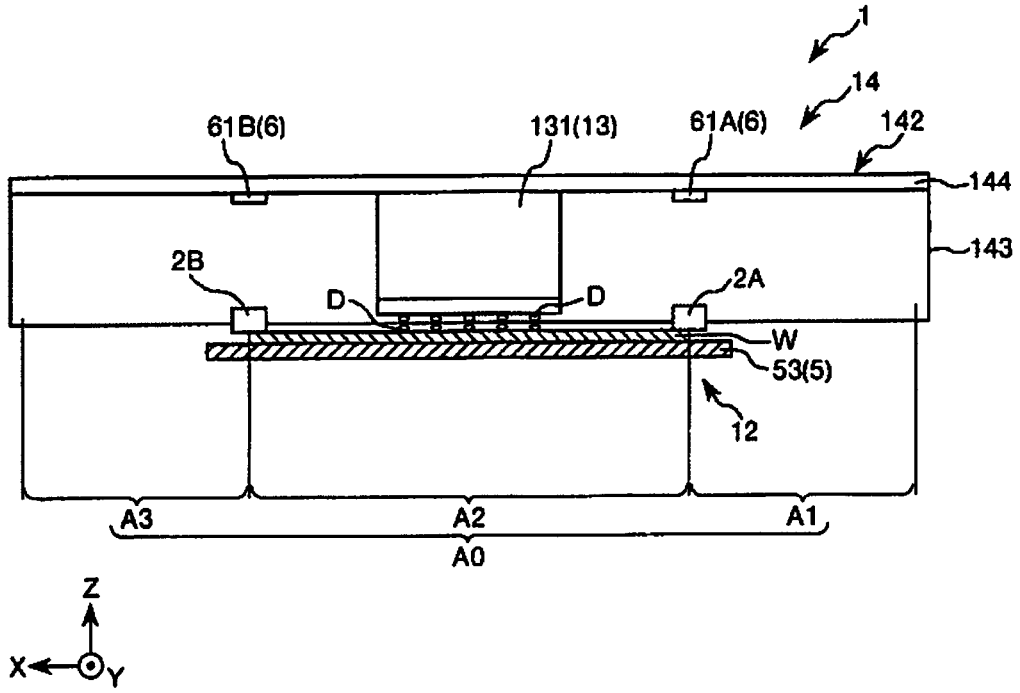
FIG. 9 is a diagram illustrating Operation Pattern 1 of the printing apparatus illustrated in FIG. 1 in the sequential manner.

Next, when the displacement of the first press member 2A is detected, the printing by the printing unit 13 is restarted, as illustrated in FIG. 9.

In such Operation Pattern 1, when the first press member 2A is displaced, the movement of the printing unit 13 in the second area A2 is stopped or the printing unit 13 is moved to a side opposite of a displaced first press member 2A, that is, to the third area A3. Therefore, the printing unit 13 is reliably prevented from colliding with the displaced first press member 2A. Furthermore, when the first press member 2A is returned to the original state after the collision is avoided, the printing by the printing unit 13 may be quickly restarted.

Next, Operation Pattern 2 will be described with reference to FIG. 10 to FIG. 12.

In the state illustrated in FIG. 10, the printing unit 13 is located in the first area A1 and is about to start printing. Furthermore, the first press member 2A is pressed upward by the joint part W3 of the work W and is thus displaced. This displacement is detected by the first optical sensor 61A. Furthermore, when the displacement of the first press member 2A is detected, the printing unit 13 waits, as is, in the first area A1.

Next, from the state illustrated in FIG. 10, the transportation of the work W is performed by the transport unit 12. Consequently, as illustrated in FIG. 11, the first press member 2A may ride over the joint part W3 that causes the displacement, and as a result, the first press member 2A returns to the original state before displacement. This displacement is also detected by the first optical sensor 61A.

Next, when the displacement of the first press member 2A is detected, the printing unit 13 moves into the second area A2 and the printing is restarted, as illustrated in FIG. 12.

In such Operation Pattern 2, when the first press member 2A is displaced, the printing unit 13 waits in the first area A1. Therefore, the printing unit 13 is reliably prevented from colliding with the displaced first press member 2A. Furthermore, when the first press member 2A is returned to the original state after the collision is avoided, the printing by the printing unit 13 may be quickly restarted. Note that here, Operation Pattern 2 is an operation pattern for when the first press member 2A is displaced, but an identical operation pattern may apply when the second press member 2B is displaced.

Next, Operation Pattern 3 will be described with reference to FIG. 13 to FIG. 16.

Figure 13:
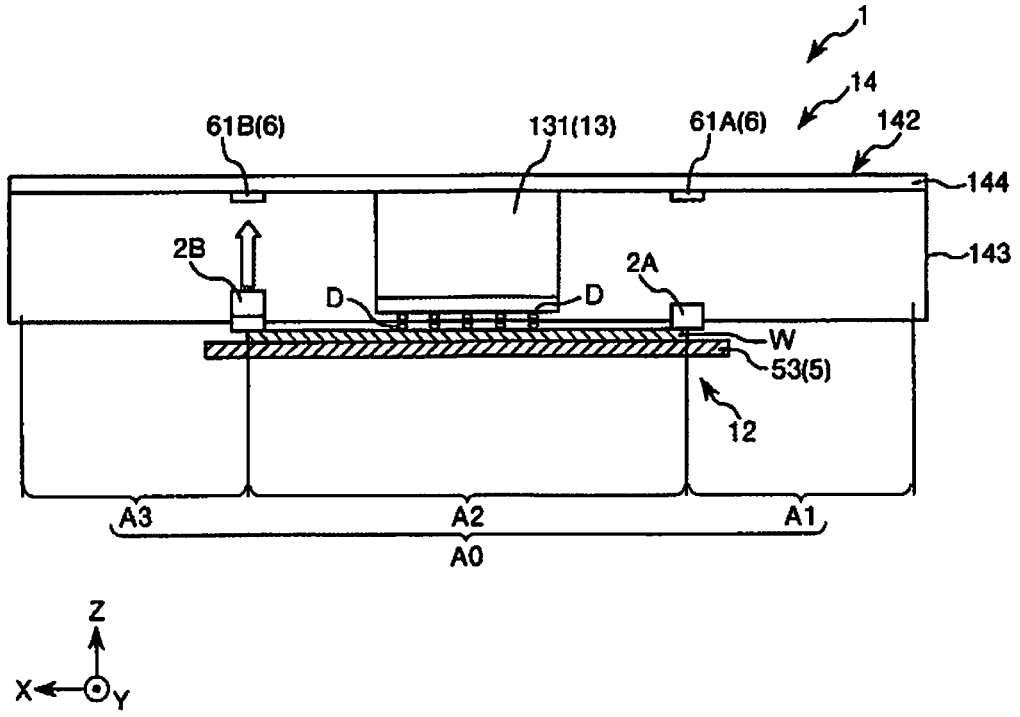
FIG. 13 is a diagram illustrating Operation Pattern 3 of the printing apparatus illustrated in FIG. 1 in a sequential manner.

In the state illustrated in FIG. 13, the printing unit 13 is located in the second area A2 and is performing printing by discharging droplet D onto the work W being transported. Furthermore, the second press member 2B is pressed upward by the joint part W3 of the work W and is thus displaced. This displacement is detected by the second optical sensor 61B (detecting unit 6).

Figure 14:
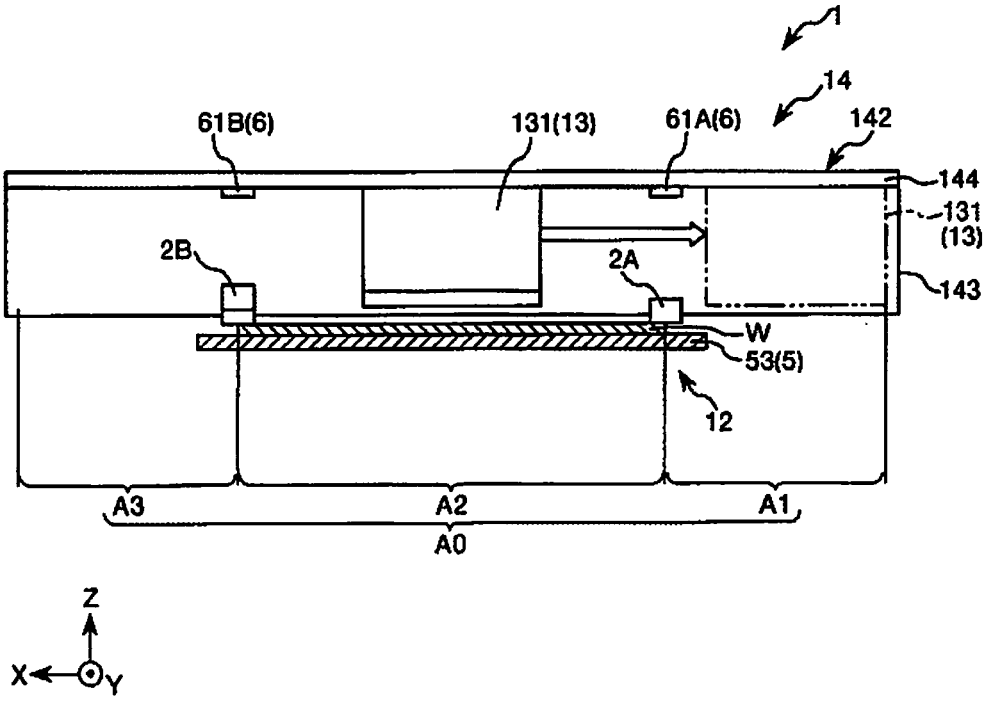
FIG. 14 is a diagram illustrating Operation Pattern 3 of the printing apparatus illustrated in FIG. 1 in the sequential manner.

When the displacement of the second press member 2B is detected, the printing by the printing unit 13 is stopped as illustrated in FIG. 14. In addition, the printing unit 13 is moved to the first area A1. Furthermore, the transportation of the work W is desirably stopped, but may be continued.

Figure 15:
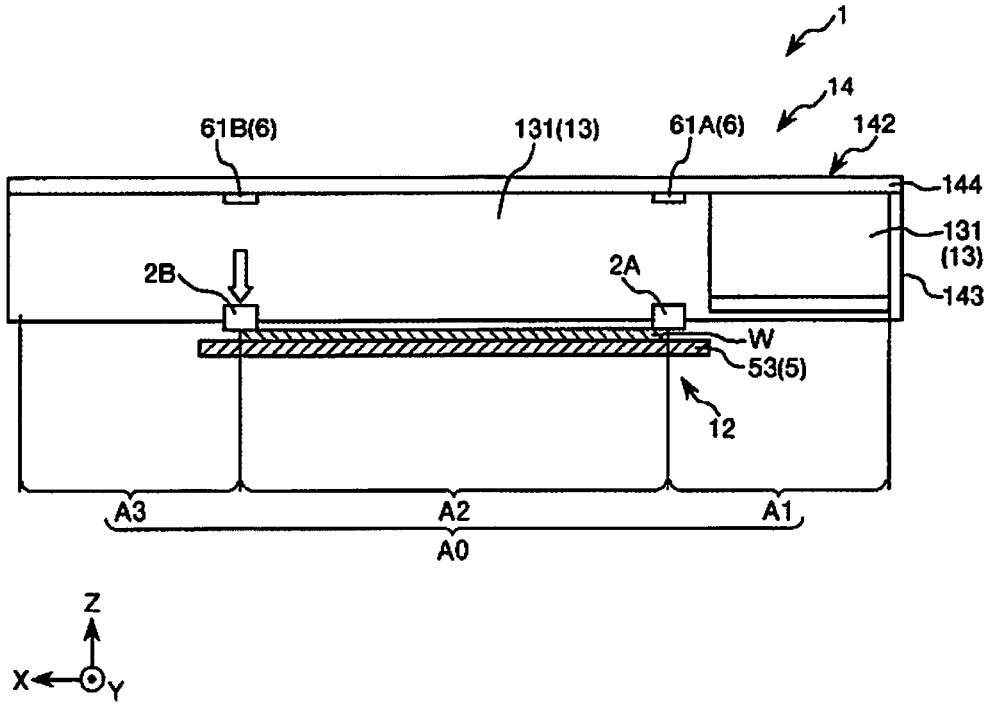
FIG. 15 is a diagram illustrating Operation Pattern 3 of the printing apparatus illustrated in FIG. 1 in the sequential manner.

Next, from the state illustrated in FIG. 14, the transportation of the work W is performed by the transport unit 12. Consequently, as illustrated in FIG. 15, the second press member 2B may ride over the joint part W3 that causes the displacement, and as a result, the second press member 2B returns to the original state before displacement. Furthermore, this displacement, that is, a displacement for returning to the original state, is also detected by the second optical sensor 61B.

Figure 16:
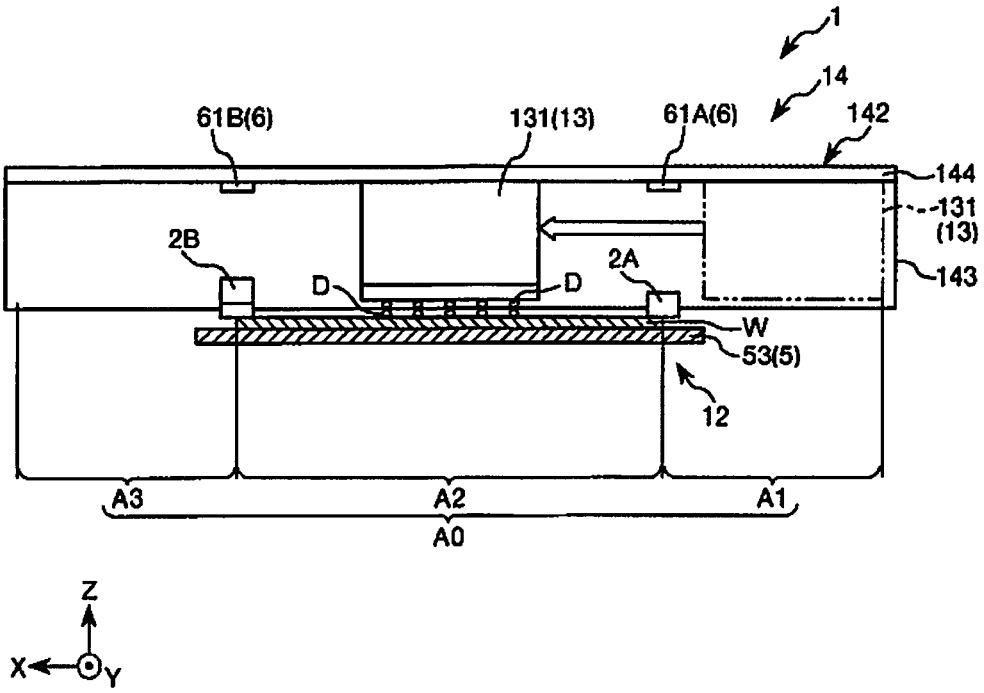
FIG. 16 is a diagram illustrating Operation Pattern 3 of the printing apparatus illustrated in FIG. 1 in the sequential manner.

Next, when the displacement of the second press member 2B is detected, the printing unit 13 is moved into the second area A2 to restart the printing, as illustrated in FIG. 16.

In such Operation Pattern 3, when the second press member 2B is displaced, the printing unit 13 is moved to a side opposite to a displaced second press member 2B, that is, to the first area A1. Therefore, the printing unit 13 is reliably prevented from colliding with the displaced second press member 2B. Furthermore, when the second press member 2B is returned to the original state after the collision is avoided, the printing by the printing unit 13 may be quickly restarted.

Next, Operation Pattern 4 will be described with reference to FIG. 17 to FIG. 19.

In the state illustrated in FIG. 17, the printing unit 13 is located in the third area A3 and is also about to move to the second area A2 to continue printing. Furthermore, the second press member 2B is pressed upward by the joint part W3 of the work W and is thus displaced. This displacement is detected by the second optical sensor 61B. Furthermore, when the displacement of the second press member 2B is detected, the printing unit 13 waits, as is, in the third area A3.

Next, from the state illustrated in FIG. 17, the transportation of the work W is performed by the transport unit 12. Consequently, as illustrated in FIG. 18, the second press member 2B may ride over the joint part W3 which causes the displacement, and as a result, the second press member 2B returns to the original state before displacement. This displacement is also detected by the second optical sensor 61B.

Next, when the displacement of the first press member 2A is detected, the printing unit 13 moves into the second area A2 to restart printing as illustrated in FIG. 19.

In such Operation Pattern 4, when the second press member 2B is displaced, the printing unit 13 waits in the third area A3. Therefore, the printing unit 13 is reliably prevented from colliding with the displaced second press member 2B. Furthermore, when the second press member 2B is returned to the original state after the collision is avoided, the printing by the printing unit 13 may be quickly restarted. Note that here, Operation Pattern 4 is an operation pattern for when the second press member 2B is displaced, but an identical operation pattern may apply to when the first press member 2A is displaced.

As described above, in the printing apparatus 1, the printing unit 13 undergoes a different movement depending on whether the displacement of the first press member 2A is detected by the detecting unit 6 or the displacement of the second press member 2B is detected by the detecting unit 6, in other words, a movement direction (moving destination) is different. Note that "waiting (stopping)" is regarded as an amount of movement of zero and is included in modes of movement.

By such controlling, as described above, both when the first press member 2A is displaced and when the second press member 2B is displaced, the printing unit 13 is reliably prevented from colliding with the displaced press member. Furthermore, the subsequent printing operation may be quickly restarted.

Furthermore, in a case where it is determined that the first press member 2A has been displaced, regardless of the amount of displacement of first press member 2A, the printing by the printing unit 13 is stopped even in response to a displacement that is too small to cause collision, and it is apprehended that the production efficiency of the printing apparatus 1 is reduced. An identical apprehension applies to the displacement of the second press member 2B.

Thus, a first threshold for an amount of displacement of the first press member 2A that likely causes collision is set, and it is determined that the first press member 2A is displaced when an actual amount of displacement of the first press member 2A exceeds the first threshold.

Similarly, a second threshold for an amount of displacement of the second press member 2B that likely causes collision is set, and it is determined that the second press member 2B is displaced when an actual amount of displacement of the second press member 2B exceeds the second threshold.

It is determined based on such first threshold and second threshold whether the displacement occurs, and hence printing by the printing unit 13 is prevented from being unwillingly (unnecessarily) stopped. Note that the first threshold and the second threshold are stored in the storage unit 152 as preset designed values or as empirically obtained.

Second Exemplary Embodiment

Figure 20:
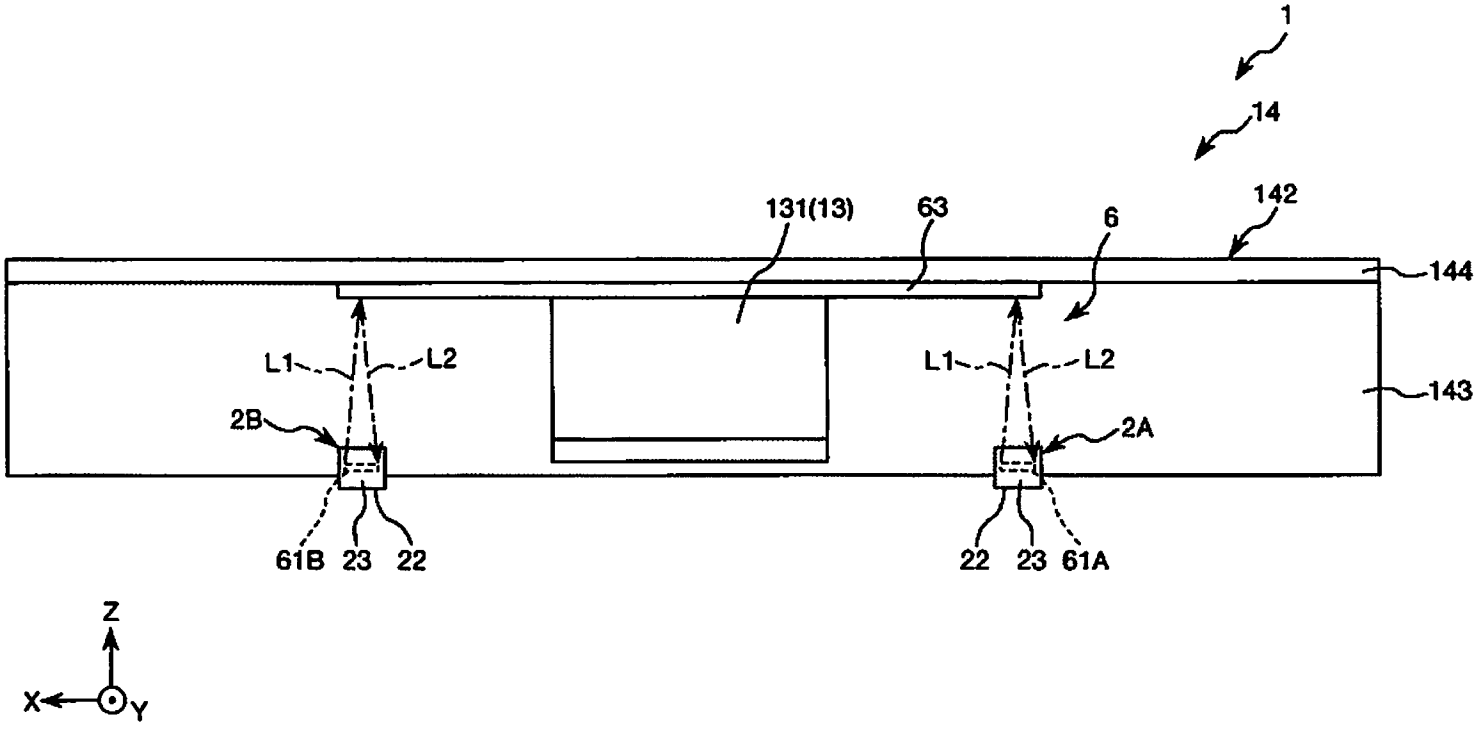
FIG. 20 is a diagram illustrating a second exemplary embodiment of the printing apparatus of the present invention.

FIG. 20 is a diagram illustrating a second exemplary embodiment of a printing apparatus of the present invention.

The second exemplary embodiment, which exemplifies a printing apparatus, a printing method, and a control apparatus of the present invention, will be described below with reference to this figure, while mainly differences from the exemplary embodiment described above will be described and a description for identical matters will not be elaborated upon.

The present exemplary embodiment is identical to the first exemplary embodiment, except that the arrangement positions of the optical sensors and the reflecting units are different.

In a printing apparatus 1 illustrated in FIG. 20, the first optical sensor 61A is arranged on and fixed to a portion of the first press member 2A as close to the free end of the contact part 22 as possible. The second optical sensor 61B is arranged on and fixed to a portion of the second press member 2B as close to the free end of the contact part 22 as possible.

Furthermore, a reflecting member 63 is provided on the top plate 144 of the frame 142 over a range (second area A2) from above the contact part 22 of the first press member 2A to above the contact part 22 of the second press member 2B. Consequently, the first optical sensor 61A and the second optical sensor 61B share a single reflecting member 63, and hence the number of parts is reduced.

The drawings of the exemplary embodiments which exemplify the printing apparatus, the printing method, and the control apparatus of the present invention have been given, however, the present invention is not limited to the descriptions above. The respective units constituting the printing apparatus and the control apparatus may be replaced with any constituents that are able to exert identical functions. Furthermore, any component may be added.

Furthermore, the printing apparatus, the printing method, and the control apparatus each may be a combination of any two or more configurations (features) of respective exemplary embodiments.

Furthermore, the detecting unit is a so-called "non-contact" sensor in each exemplary embodiment, but is not limited and may be, for example, a "contact" sensor.

REFERENCE SIGNS LIST

1 . . . Printing apparatus, 2A . . . First press member, 2B . . . Second press member, 21 . . . Fixed part, 22 . . . Contact part, 23 . . . Inclined part, 3 . . . Unwinding device, 31 . . . Feeding roller (Unwinding reel), 32 . . . Tensioner, 4 . . . Winding device, 41 . . . Winding roller (Winding reel), 42 . . . Tensioner, 43 . . . Tensioner, 44 . . . Tensioner, 5 . . . Supporting device, 51 . . . Main driving roller, 52 . . . Driven roller, 53 . . . Endless belt (Belt), 54 . . . Tensioner, 55 . . . Tensioner, 6 . . . Detecting unit, 61A . . . First optical sensor, 61B . . . Second optical sensor, 62A . . . First reflecting member (Reflecting unit), 62B . . . Second reflecting member (Reflecting unit), 63 . . . Reflecting member, 11 . . . Machine base, 12 . . . Transport unit, 13 . . . Printing unit, 131 . . . Carriage unit, 14 . . . Moving unit, 141 . . . Drive source, 142 . . . Frame, 143 . . . back plate, 144 . . . top plate, 15 . . . controller, 151 . . . CPU (Central Processing Unit), 152 . . . Storage unit, 16 . . . Drying unit, 161 . . . Chamber, 18 . . . Input operation unit, 200 . . . External power supply source, A0 . . . Movement range, A1 . . . First area, A2 . . . Second area, A3 . . . Third area, D . . . Droplet, L1 . . . Emitted light, L2 . . . Reflected light, LT1 . . . First movement limit position, LT2 . . . Second movement limit position, M . . . Distance, W . . . Work, W1 . . . Edge, W2 . . . Edge, W3 . . . Joint part

The invention claimed is:

1. A printing apparatus comprising:

a transport unit configured to transport a recording medium that is band-shaped in a longitudinal direction of the recording medium;

a printing unit configured to perform printing on the recording medium while moving in a width direction of the recording medium;

a first press member configured to press one side of the recording medium in the width direction;

a second press member configured to press another side of the recording medium in the width direction;

a detecting unit configured to detect each of a displacement of the first press member in a vertical direction and a displacement of the second press member in a vertical direction; and a control unit configured to control the printing unit such that the printing unit undergoes a different movement depending on whether the displacement of the first press member is detected by the detecting unit or the displacement of the second press member is detected by the detecting unit.

2. The printing apparatus according to claim 1, wherein the detecting unit detects that the first press member is displaced in the vertical direction when an amount of the displacement of the first press member exceeds a threshold, and the detecting unit detects that the second press member is displaced in the vertical direction when an amount of the displacement of the second press member exceeds a threshold.

3. The printing apparatus according to claim 1, wherein the first press member and the second press member each include a plate piece that is cantilevered, and the detecting unit detects a displacement of an end portion of the plate piece on a free end side.

4. The printing apparatus according to claim 3, wherein the detecting unit is arranged on the end portion of the plate piece on the free end side or includes an optical sensor, which is reflective, arranged to face the end portion of the plate piece on the free end side.

5. The printing apparatus according to claim 4, wherein the detecting unit includes a reflecting unit configured to reflect light from the optical sensor, the optical sensor is arranged on the end portion of the plate piece on the free end side, and the reflecting unit is provided over a range from above the first press member to above the second press member.

6. The printing apparatus according to claim 1, wherein the printing unit is movable between a first movement limit position that is a movement limit on a first press member side and a second movement limit position that is a movement limit on a second press member side, and a movement range in which the printing unit is movable is divided into a first area from the first movement limit position to above the first press member, a second area from above the first press member to above the second press member, and a third area from above the second press member to the second movement limit position.

7. The printing apparatus according to claim 6, wherein when the displacement of the first press member is detected with the printing unit located in the second area, the printing unit stops the printing and waits in the second area or moves to the third area.

8. The printing apparatus according to claim 7, wherein when the printing unit waits in the second area or moves to the third area, the transport unit transports the recording medium until the first press member returns to an original state before the first press member is displaced.

9. The printing apparatus according to claim 8, wherein when the transport unit transports the recording medium until the first press member returns to the original state before the first press member is displaced, the printing is restarted.

10. The printing apparatus according to claim 6, wherein when the displacement of one of the press members that are the first press member and the second press member is detected with the printing unit located in the first area, the printing unit waits in the first area.

11. The printing apparatus according to claim 10, wherein when the printing unit waits in the first area, the transport unit transports the recording medium until the one of the press members returns to an original state before the one of the press members is displaced.

12. The printing apparatus according to claim 11, wherein when the transport unit transports the recording medium until the one of the press members returns to the original state before the one of the press members is displaced, the printing is restarted.

13. The printing apparatus according to claim 6, wherein when the displacement of the second press member is detected with the printing unit located in the second area, the printing unit stops the printing and moves to the first area.

14. The printing apparatus according to claim 13, wherein when the printing unit moves to the first area, the transport unit transports the recording medium until the second press member returns to an original state before the second press member is displaced.

15. The printing apparatus according to claim 14, wherein when the transport unit transports the recording medium until the second press member returns to the original state before the second press member is displaced, the printing is restarted.

16. The printing apparatus according to claim 6, wherein when the displacement of one of the press members that are the first press member and the second press member is detected with the printing unit located in the third area, the printing unit waits in the third area.

17. The printing apparatus according to claim 16, wherein when the printing unit waits in the third area, the transport unit transports the recording medium until the one of the press members returns to an original state before the one of the press members is displaced.

18. The printing apparatus according to claim 17, wherein when the transport unit transports the recording medium until the one of the press members returns to the original state before the one of the press members is displaced, the printing is restarted.

19. A printing method of performing printing on a recording medium using the printing apparatus according to claim 1.

20. A non-transitory computer readable medium which stores a program to control the printing apparatus according to claim 1, the program causing the control unit to control the printing unit to undergo a different movement depending on whether the displacement of the first press member is detected or the displacement of the second press member is detected.

* * * * *